US012292232B2

(12) United States Patent
Demuth et al.

(10) Patent No.: US 12,292,232 B2
(45) Date of Patent: May 6, 2025

(54) COLD STORAGE DEVICE

(71) Applicant: B Medical System S.A.R.L, Hosingen (LU)

(72) Inventors: Jeannot Demuth, Eschdorf (LU); Vincent Sadler, Mont-Saint-Guibert (BE); Gilles Ries, Mont-Saint-Guibert (BE)

(73) Assignee: B MEDICAL SYSTEM S.A.R.L, Hosingen (LU)

( * ) Notice: Subject to any disclaimer, the term of this patent is extended or adjusted under 35 U.S.C. 154(b) by 128 days.

(21) Appl. No.: 17/291,298

(22) PCT Filed: Nov. 5, 2019

(86) PCT No.: PCT/EP2019/080148
§ 371 (c)(1),
(2) Date: May 5, 2021

(87) PCT Pub. No.: WO2020/094589
PCT Pub. Date: May 14, 2020

(65) Prior Publication Data

US 2022/0003481 A1 Jan. 6, 2022

(30) Foreign Application Priority Data

Nov. 7, 2018 (GB) ..... 1818133

(51) Int. Cl.
*F25D 3/06* (2006.01)
*B65D 81/38* (2006.01)
(Continued)

(52) U.S. Cl.
CPC ..... *F25D 3/06* (2013.01); *B65D 81/38* (2013.01); *F25D 23/066* (2013.01);
(Continued)

(58) Field of Classification Search
CPC . F25D 3/06; F25D 23/066; F25D 3/02; F25D 2400/02; F25D 11/003; F25D 2201/10; F25D 2700/12; B65D 81/38
See application file for complete search history.

(56) References Cited

U.S. PATENT DOCUMENTS 6,222,160 B1 4/2001 Remke
2004/0226309 A1* 11/2004 Broussard ..... F25D 11/003 62/236

(Continued)

FOREIGN PATENT DOCUMENTS

EP 1421323 5/2004
WO 20170090019 6/2017

OTHER PUBLICATIONS

International Search Report and Written Opinion for corresponding PCT application PCT/EP2019/080148.

(Continued)

*Primary Examiner* — Frantz F Jules
*Assistant Examiner* — Martha Tadesse
(74) *Attorney, Agent, or Firm* — Jerold I. Schneider; SCHNEIDER IP LAW

(57) ABSTRACT

An ice-lined cold storage device (10) comprising: a cold storage compartment (15) arranged at an interior of the ice-lined cold storage device; an ice-lining (25*a*, 25*b*, 25*c*, 25*d*) configured to absorb heat from the interior of the cold-storage device; a cooling circuit (16) configured, when in operation, to remove heat from the ice-lining; an inner liner (22) arranged between the cold storage compartment and the ice-lining, the inner liner comprising a sheet material (23) having a major surface which faces towards the cold storage compartment and a major surface (27) which faces towards the ice-lining; is provided with an electrical heating element (26) arranged at one of the said major surfaces of (Continued)

the inner to provide heat to the interior of the cold storage device.

15 Claims, 2 Drawing Sheets

(51) Int. Cl.
*F25D 23/06* (2006.01)
*F25D 11/00* (2006.01)

(52) U.S. Cl.
CPC ..... *F25D 11/003* (2013.01); *F25D 2201/10* (2013.01); *F25D 2400/02* (2013.01)

(56) References Cited

U.S. PATENT DOCUMENTS

| | | | | |
|---|---|---|---|---|
| 2006/0107680 | A1 | 5/2006 | Overbeck | |
| 2014/0338390 | A1* | 11/2014 | Pinto | F25D 11/006 165/96 |
| 2018/0023876 | A1 | 1/2018 | Muller | |
| 2018/0333330 | A1* | 11/2018 | Nagar | A61M 5/002 |

OTHER PUBLICATIONS

International Preliminary Report on Patentability for corresponding PCT application PCT/EP2019/080148.

* cited by examiner

COLD STORAGE DEVICE

This invention relates to a cold storage device, particularly an ice-lined refrigerator and more particularly a solar powered ice-lined refrigerator, notably for vaccines and/or medical products.

To ensure their quality, longevity and effectiveness, vaccines must be stored and transported at an optimum storage temperature, generally ≥+2° C. and ≤+8° C. Exposure to higher or lower temperatures causes deterioration of the vaccines. Specialised vaccine storage refrigerators address these and other practical requirement, for example the avoidance of any significant temperature variation between different positions within a vaccine storage chamber. An example of a specialised ice-lined vaccine refrigerator is disclosed in WO 2015/120911.

One aim of the present invention is to provide an improved ice-lined vaccine refrigerator.

In accordance with one of its aspects, the present invention provides a cold storage device in accordance with claim 1. Other aspects are defined in other independent claims. The dependent claims define preferred or alternative features.

In one of its aspects, the present invention is based on the realisation that a significant improvement in ice-lined cold storage devices can be made by focussing on an improved arrangement for ensuring that the temperature in the cold storage chamber does not fall below a desired minimum temperature. In the case of a vaccine refrigerator the desired minimum temperature is generally 2° C. In particular, this aspect is based upon ensuring that the temperature in the cold storage chamber does not fall below its desired minimum temperature by providing an improved arrangement for a heater within the cold storage device. The ice-lining of the storage device when in use will generally be at a temperature which is ≤0° C.; indeed it can be advantageous for the ice-lining to be chilled to a temperature which is below its freezing temperature so as to increase the hold-over time of the cold storage device i.e. the duration for which the cold storage compartment may be maintained below its maximum permissible temperature without the supply of energy to provide active cooling. One challenge of ice-lined cold storage devices is thus how to reconcile a temperature of an ice-lining which is ≤0° C. with a requirement for ensuring that the temperature of the cold storage compartment does not fall below, for example 2° C.

An arrangement in which:

- an inner liner is interposed between the cold storage compartment and the ice-lining, the inner liner comprising a sheet material having a major surface which faces towards the cold storage compartment and a major surface which faces towards the ice-lining; and
- an electrical heating element is arranged at one of the said major surfaces of the inner liner to provide heat to the cold storage compartment; allows for a number of synergistic advantages. These include:
- the ability to provide a heat source at the inner liner and thus form a heated separation between the cold storage compartment and the ice-lining;
- the ability in some cases to use heat conduction through the inner liner to facilitate the provision of heat around the entire cold storage compartment;
- the ability to use simple, compact and readily available components, for example an electrical heating element, notably an electrical heating wire; and
- the ability to reduce the volume of the heating arrangement, particularly to avoid the need for a heating arrangement at a base of the cold storage compartment, and thus to increase the volume of the cold storage compartment which is available for storing vaccines or other goods.

These advantages can be seen, for example, with respect to the heating arrangement disclosed in WO 2015/120911.

As used herein, the term "ice-lined cold storage device" means a device configured to maintain its cold storage compartment within a controlled temperature range which is below the temperature of its surroundings and to generate an ice lining which acts as a thermal capacitor; in the event of a power interruption the pre-formed ice lining absorbs heat from its surroundings and contributes to maintaining the cold storage compartment within its desired temperature range. For example, where the cold storage device is solar powered, power interruptions will occur when insufficient solar power is available to provide cooling, for example if the solar panels are shaded by clouds or at night.

The ice-lining is preferably water or a water-based ice-lining, for example water comprising one or more additive; the use of water or a water-based ice-lining, notably comprising at least 70 wt %, at least 80 wt % or at least 90 wt % water, allows the use of readily available materials, facilitates maintenance and replacement and allows the ice-lining to be provided by containers which can be filled locally rather than being transported ready-filled. Alternatively, the ice-lining may be a paraffin, a wax, and oil, a fattty acid; or a polyglycol. Preferably, the ice-lining comprises removeable ice-packs; this facilitates construction, transport and maintenance.

The volume of the cold storage compartment may be ≥15 L and/or ≤260 L; this provides for storage or a suitable quantity of vaccines. It may be ≥40 L, ≥50 L or ≥55 L and/or ≤1500, L≤100 L, ≤90 L or ≤85 L.

The hold over time of the cold storage device may be ≥10 hours, ≥12 hours, or ≥14 hours when tested with a surrounding temperature of 32° C.; it may be 4 hours, ≥6 hours, or ≥8 hours when tested with a surrounding temperature of 43° C. Particularly for mains powered cold storage devices, the hold over time is preferably ≥20 hours with a surrounding temperature of 27° C. and/or 32° C. and/or 43° C.; particularly for solar powered cold storage devices, the hold over time is preferably ≥72 hours with a surrounding temperature of 27° C. and/or 32° C. and/or 43° C.

The cold storage compartment is preferably entirely filled with air; it may be provided with a means for evacuating any condensation that forms from cooling of the air, for example a drain or water outlet.

The cooling circuit is configured, when in operation, to remove heat from the ice-lining. Preferably, the chilling of the ice-lining serves to simultaneously provide for chilling of the cold storage compartment; this simplifies construction by avoiding the need for a separate chilling arrangement for the cold storage compartment. The cooling circuit is preferably powered by a renewable energy source, more preferably by one of more solar panels. The solar panels or other power source may provide a DC voltage, notably a voltage of 12V±2V or 24V±2V and a power which is selected from i) a power which is ≥300 W, or ≥350 W and/or ≤500 W or ≤450 W and ii) a power which is ≥700 W, or ≥750 W and/or ≤900 W or ≤850 W. The cooling circuit may be powered by a wind turbine. Alternatively, the cooling circuit may be mains powered, for example from an AC power grid. The cooling circuit may be an AC operated cooling circuit; it may be a DC operated cooling circuit, for example powered from a mains supply by an AC-DC power converter. The electrical heater is preferably powered by the same power source as the cooling circuit. The electrical heater is preferably configured to operate with a power consumption which is ≥5 W or ≥8 W and/or ≤50 W, ≤30 W or ≤15 W. The ability to provide an effective temperature safeguard with such low levels of power consumption of the electrical heater enables the heater to function even when a small amount of power is available which would not be sufficient to operate the cooling circuit. Thus, for example, when the ice-lined cold storage device is powered by solar panels, as dusk approaches the available solar power will fall to a level insufficient to power the cooling circuit and the ambient temperature will likewise fall. The fall in ambient temperature provides a risk of the temperature of the cold storage compartment falling below its desired minimum temperature but the lower power requirement of the electrical heater can be supplied from the lower level of power still available from the solar panels.

The ice-lining preferably extends around at least 50%, at least 60%, at least 70% or at least 80% of periphery of the cold storage compartment; this helps to ensure consistency of the temperature within the cold storage compartment. The inner lining preferably circumscribes the cold storage compartment and defines a substantially continuous perimeter of the cold storage compartment; this provides an effective separation between the cold storage compartment and the ice-lining.

The electrical heating element may comprise one of more substantially flat heating elements and/or one of more electrical heating wires; the compactness of such heating elements minimises the space that they take up. In a particularly preferred arrangement, the heating element comprises a single electrical heating wire; this may easily be arranged at one of the major surfaces of the inner liner, for example by being adhered to the major surface. Where one or more heating wire are used, the heating wire may be arranged with a sleeve, for example an electrically insulating sleeve. The electrical heating wire may be rectilinear; this simplifies its construction. Alternatively, the electrical heating wire may have an undulating or wave-like form; this may be used to increase its contact length with the inner liner and thus facilitate heat distribution. The electrical heating element is preferably attached to and/or supported by the inner liner; it may be secured to the inner liner by an adhesive, for example by an adhesive tape or a double-sided adhesive tape which holds the electrical heating element against the inner liner.

The inner liner may comprise a heat conducting sheet, notably a metal sheet, having a major surface which faces towards the cold storage compartment and a major surface which faces towards the ice-lining. Particularly in this case, the electrical heating element may be arranged at, and preferably contacts, the major surface of the heat conducting sheet which faces the ice-lining. This arrangement allows good heat distribution through the metal sheet whilst using the inner liner to shield the electrical heating element from direct contact or potential damage from the cold storage compartment. The heat conducting sheet may have a thermal conductivity measured at 0° C. which is ≥10 $W \cdot m^{-1} \cdot K^{-1}$ or ≥20 $W \cdot m^{-1} \cdot K^{-1}$ and preferably which is ≥50 $W \cdot m^{-1} \cdot K^{-1}$ or ≥100 $W \cdot m^{-1} \cdot K^{-1}$. An aluminium or aluminium alloy metal sheet for the inner liner provides a useful combination of thermal conduction, physical separation and low weight. The heat conducting or metal sheet may have a thickness which is ≥1 mm or ≥2 mm and/or ≤5 mm or ≤4 mm.

It is particularly preferred for the inner liner to comprise:

- a heat conducting sheet, notably a metal sheet, having a major surface which faces towards the cold storage compartment and a major surface which faces towards the ice-lining; and
- a thermally insulating material, notably a sheet of insulating foam for example expanded polypropylene or expanded polystyrene, which separates the cold storage compartment from the ice-lining and which is arranged between the heat conducting sheet and the ice-lining.

The thermally insulating material may have a thermal conductivity measured at 0° C. which is ≤100 $mW \cdot m^{-1} \cdot K^{-1}$ or ≤80 $mW \cdot m^{-1} \cdot K^{-1}$ and preferably which is ≤50 $mW \cdot m^{-1} \cdot K^{-1}$ or ≤40 $mW \cdot m^{-1} \cdot K^{-1}$.

The inner liner preferably forms a continuous barrier between the cold storage compartment and the ice-lining having a continuous metal sheet facing the cold storage compartment and a continuous thermal insulating layer facing the ice lining. The combined effect of the insulating layer and the metal sheet of the inner liner provides an advantageous combination of thermal conduction adjacent to the cold storage compartment to mitigate temperature differences within the cold storage compartment, control of heat flow from the cold storage compartment to the ice-lining to avoid over-chilling the cold storage compartment, physical separation and low weight. Arranging the electrical heating element between the heat conducting sheet of the inner liner and the thermal insulating material of the inner liner further enhances these effects.

Arranging for the heating element to extend around at least 70%, at least 80% or at least 90% of the perimeter of the inner liner and/or the perimeter of the cold storage compartment facilitates heat distribution for the entire cold storage compartment. Arranging the electrical heating element at or near a central plane of the height of the cold storage compartment may be used to simplify the arrangement whilst ensuring that the effect of the electrical heating element extends to the entire cold storage compartment and/or entire inner liner. For example, the electrical heating element may be arranged at a position within the cold storage device which is between i) a horizontal plane which intersects a height corresponding to 25% of the height of the cold storage compartment and/or the inner liner from its base and ii) a horizontal plane which intersect a height corresponding to 75%, 65%, 60% or preferably 55% of the height of the cold storage compartment and or the inner liner from its base.

Operation of the electrical heating element may be controlled on the basis of a temperature sensor arranged within the cold storage compartment. For example, the electrical heating element may be turned on when the measured temperature approaches but has not yet reached the defined minimum temperature and turned off once a sufficient safety margin temperature has been detected. Arranging the temperature sensor to contact the inner liner, particularly an inner surface of the inner liner provides a convenient configuration. Preferably, the same temperature sensor is used to control operation of the electrical heating element and operation of the cooling circuit; this simplifies the configuration.

In accordance with another aspect, the present invention provides an ice-lined storage device comprising:

- a cold storage compartment arranged at an interior of the ice-lined cold storage device;
- an ice-lining configured to absorb heat from the interior of the cold-storage device;

a cooling circuit configured, when in operation, to remove heat from the ice-lining;

an inner liner arranged between the cold storage compartment and the ice-lining, the inner liner surrounding the cold storage compartment and defining a substantially continuous perimeter of the cold storage compartment, and the inner liner comprising i) a sheet metal material having a major surface which faces towards the cold storage compartment and a major surface which faces towards the ice-lining and ii) a thermally insulating sheet material comprising insulating foam arranged between the sheet metal material and the ice-lining; and an electrical heating element arranged between the metal sheet of the inner liner and the thermal insulating sheet of the inner liner.

In accordance with a further aspect, the present invention provides a method of maintaining goods, for example vaccines, within a pre-defined temperature range in a cold storage device, the method comprising a) providing an ice-lined cold storage device comprising:

a cold storage compartment arranged at an interior of the ice-lined cold storage device;

an ice-lining configured to absorb heat from the interior of the cold-storage device;

a cooling circuit configured, when in operation, to remove heat from the ice-lining;

an inner liner arranged between the cold storage compartment and the ice-lining, the inner liner comprising a sheet material having a major surface which faces towards the cold storage compartment and a major surface which faces towards the ice-lining; and an electrical heating element arranged at one of the said major surfaces of the inner liner; and b) operating the cooling circuit to remove heat from the ice-lining; and c) operating the electrical heating element to provide heat to the interior of the cold storage device.

The operation of the electrical heating element may be carried out subsequently to the operation of the cooling circuit.

Each of the cooling circuit and the electrical heating element may be operated periodically. The cooling circuit and the electrical heating element may be operated simultaneously; each may be operated at a time when the other is not being operated.

One advantageous operating mode of a cold storage device, notably a cold storage device described herein, comprises a minimum temperature maintenance procedure. In this procedure, in order to avoid a risk of the temperature of the cold storage compartment falling below its minimum desired temperature, upon detection of the temperature of the cold storage compartment approaching its desired minimum temperature, a control system i) ensures that the cooling circuit is not operated to avoid removing further heat and ii) operates the electrical element to provide heat to the interior of the cold storage device.

Another advantageous operating mode of a cold storage device, notably a cold storage device described herein, comprises an enhanced ice-liner chilling procedure. In this procedure, which may be used for example upon initial start-up of the cold storage device, the electrical element is operated to provide heat during operation of the cooling circuit. This allows a greater amount of heat to be removed from the ice-lining whilst preventing the temperature of the cold storage compartment from reaching a pre-defined minimum temperature. By removing additional heat from the ice-lining in this way the hold-over time of the cold storage device can be increased.

An embodiment of the invention will now be described, by way of example only, with reference to the accompanying drawings, of which:

Figure 1:
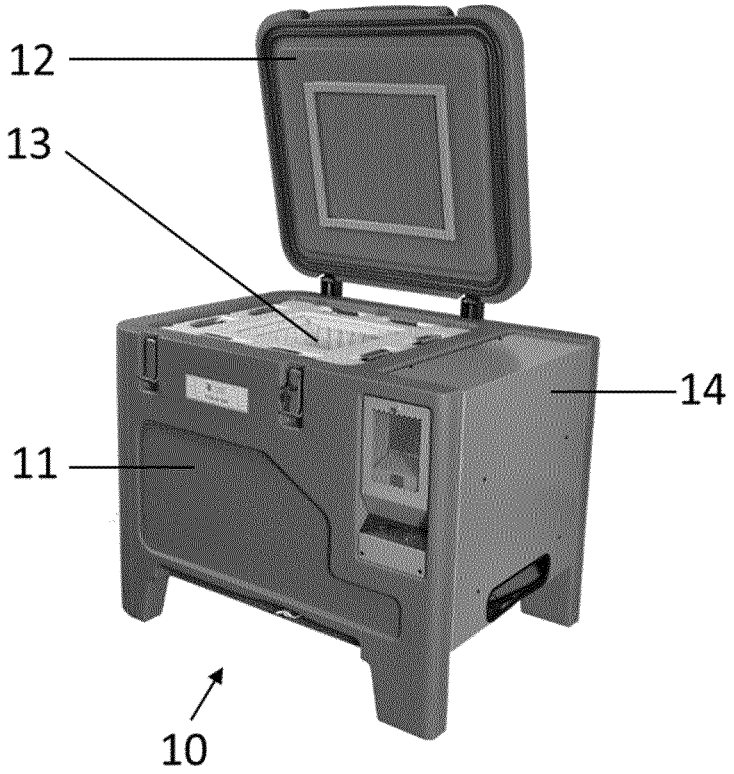
FIG. 1 is a schematic perspective view of an ice-lined cold storage device.

The ice-lined vaccine refrigerator 10 comprises an insulated, moulded body 11 having an insulated pivoted lid 12. A cooling space 13 within the body 11 is accessible when the lid 12 is open and sealable by closing of the lid 12. Electrical components and control circuitry of the refrigerator 10 are arranged within a component housing 14 which is incorporated into the mounded body 11.

In particular, the ice-lined vaccine refrigerator 10 comprises:

a vaccine storage compartment 15 within the cooling space 13;

an electrically powered cooling circuit 16, a power inlet 17 adapted for connection to an external supply of DC power provided from solar panels or from an AC-DC power converter; and a compressor 18 forming part of the electrically powered cooling circuit 16 of the vaccine refrigerator 10.

The electrically powered cooling circuit 16 comprises: four flat plate evaporators 19*a*, 19*b*, 19*c*, 19*d*, each arranged at a peripheral side wall of the cooling space 13, the evaporators being fed with refrigerant which is circulated by the compressor 18 through a condenser 20, subsequently through a capillary tube or expansion valve 21 and subsequently through the evaporators before returning to the compressor 18.

An inner liner 22 is arranged within the cooling space 13, the internal periphery of the inner liner 22 defining the peripheral side walls of cold storage compartment 15. The inner liner 22 comprises a substantially continuous metal sheet 23, notably an aluminium sheet, having a thickness of 1-2 mm, and a substantially continuous layer of insulation 24, notably sheets of expanded polypropylene or expanded polystyrene having a thickness of about 8 mm which are adhered to and cover each major surface of the metal sheet which faces an evaporator plate 19*a*, 19*b*, 19*c*, 19*d*. This is an example of a preferred configuration in which the inner liner provides a substantially continuous sleeve or barrier which separates the cold storage compartment 15 from the ice lining.

Figure 2:
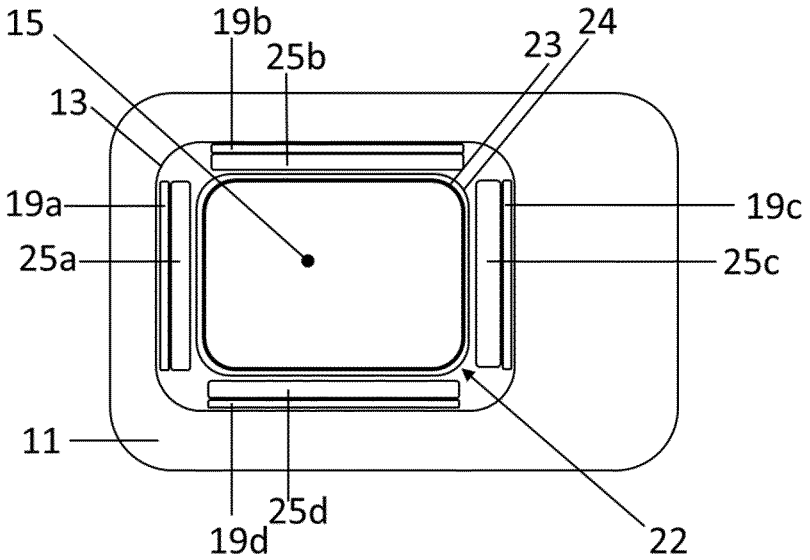
FIG. 2 is a schematic top view (without the lid) of the ice-lined cold storage device.
Figure 3:
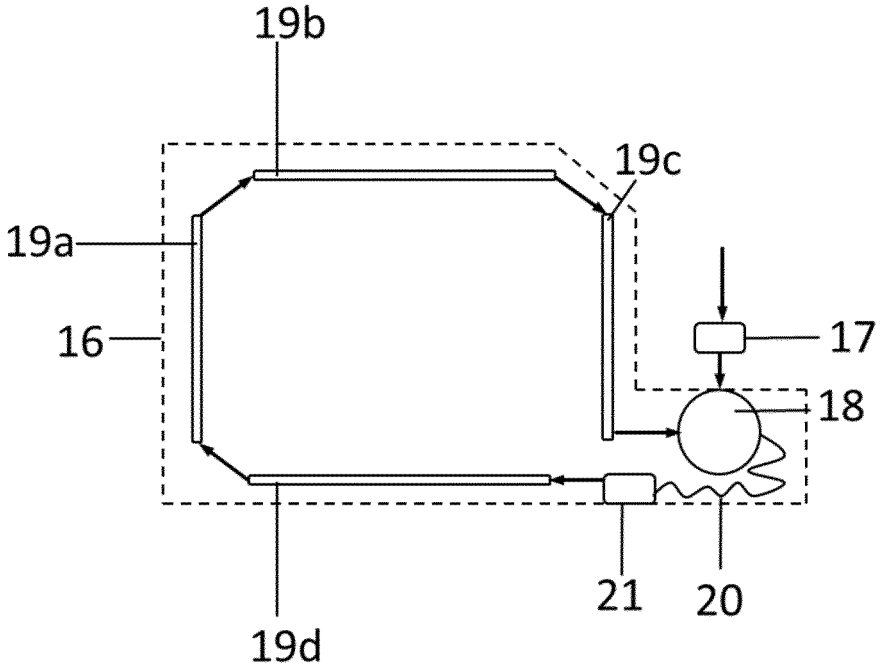
FIG. 3 is a schematic view showing an electrically powered cooling circuit of the ice-lined cold storage device.

A removeable ice pack 25*a*, 25*b*, 25*c*, 25*d* is arranged in each of the spaces between the evaporator plates 19*a*, 19*b*, 19*c*, 19*d* and the inner liner 22. The ice packs 25*a*, 25*b*, 25*c*, 25*d* thus form an ice lining which in this case provides an ice lining at each of four sides of a substantially rectangular vaccine storage compartment 15. In operation, the electrically powered cooling circuit 16 freezes the icepacks 25*a*, 25*b*, 25*c*, 25*d* which generates an ice lining and cools the vaccine storage compartment 15. As illustrated in FIG. 2, the ice lining does not extent around corner sections of the cold storage compartment 15 but nevertheless extends around the majority and in the illustrated case at least 80% of the periphery of the cold storage compartment 15. Arrangement of the thermally insulated inner liner 22 between the ice packs 25*a*, 25*b*, 25*c*, 25*d* and the vaccine storage compartment 15 reduces the risk of undesirably cooling the vaccine storage compartment 15 to a temperature of below +2° C.

Figure 4:
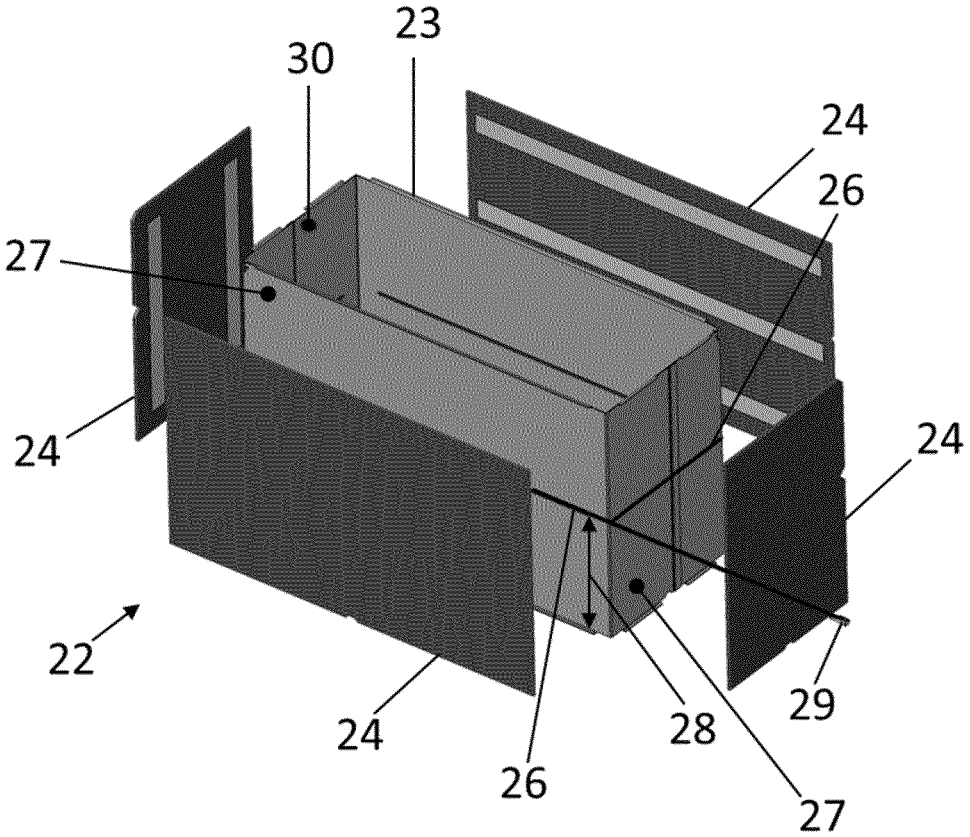
FIG. 4 is a schematic exploded perspective view of an inner liner and electrical heater.

FIG. 4 illustrates an electrical heating element in the form of a single electrical heating wire 26 which is adhered to a major surface of the inner liner 22, in this case the major surface 27 of the metal sheet 23 which faces the ice lining 25*a*, 25*b*, 25*c*, 25*d*. The electrical heating wire 26 is thus positioned between the metal sheet 23 and the insulating sheet 24 of the inner liner 22 and passes around the entire periphery of n the inner liner 22 and of the cold storage compartment at a height 28 which corresponds to a horizontal plane which intersects a height corresponding to 50% of the height of the inner liner 22 from its base and which also corresponds in the illustrated example to 50% of the height of the cold storage compartment 15 from its base. The electrical wire heating element 26 comprises a wire loop within an electrically insulated sleeve with each of the two ends of the loop arranged at an electrical heating wire connector 29. A temperature sensor 30 contacts a major surface of metal sheet 23 of the inner liner 22, in the illustrated case the major surface of the inner liner 22 which is in direct contact with the air in the cold storage compartment 15, to provide an indication of the temperature of the cold storage compartment 15. The height position of the temperature sensor is preferably offset from the height position of the electrical heating wire to mitigate against direct heat transfer creating an erroneous temperature reading.

LIST OF REFERENCE NUMBERS

10 ice-lined vaccine refrigerator
11 moulded body
12 lid
13 cooling space
14 component housing
15 vaccine storage compartment
16 electrically powered cooling circuit
17 power inlet
18 compressor
19*a* evaporator
19*b* evaporator
19*c* evaporator
19*d* evaporator
20 condenser
21 expansion valve
22 inner liner
23 metal sheet of inner liner
24 insulation sheet of inner liner
25*a* ice pack
25*b* ice pack
25*c* ice pack
25*d* ice pack
26 electrical heating wire
27 major surface of metal sheet of inner liner
28 height of electrical heating wire
29 electrical heating wire connector
30 temperature sensor

The invention claimed is:

1. An ice-lined cold storage device comprising:
an insulated body;
a cooling space within the insulated body;
a cold storage compartment within the cooling space arranged at an interior of the ice-lined cold storage device;
an ice-lining configured to absorb heat from the interior of the cold-storage device;
a cooling circuit configured, when in operation, to remove heat from the ice-lining;
an inner liner arranged between the cold storage compartment and the ice-lining, in which the inner liner circumscribes the cold storage compartment and defines a substantially continuous perimeter of the cold storage compartment, and in which the inner liner comprises
a heat conducting metal sheet having a first major surface which faces towards the cold storage compartment and a second major surface which faces towards the ice-lining; and
a thermally insulating material which separates the cold storage compartment from the ice-lining and which is arranged between the heat conducting sheet and the ice-lining; and in which
an electrical heating element is arranged between the heat conducting sheet of the inner liner and the thermal insulating material of the inner liner,
wherein the electrical heating element is an electrical heating wire, and
wherein the electrical heating element extends around at least 70% of a perimeter of the inner liner.

2. The ice-lined cold storage device of claim 1, wherein the thermally insulating material which separates the cold storage compartment from the ice-lining comprises a thermally insulating foam.

3. The ice-lined cold storage device of claim 1, wherein the electrical heating element extends around at least 90% of the perimeter of the inner liner.

4. The ice-lined cold storage device of claim 1, wherein the electrical heating element is arranged at a position within the cold storage device which is between i) a horizontal plane which intersects a height corresponding to 25% of the height of the cold storage compartment from its base, and ii) a horizontal plane which intersects a height corresponding to 75% of the height of the cold storage compartment from its base.

5. The ice-lined cold storage device of claim 1, further comprising i) a temperature sensor configured to provide an indication of a temperature of the cold storage compartment, and ii) a control system which controls operation of the electrical heating element on the basis of the indication of a temperature of the cold storage compartment provided by the temperature sensor, wherein the temperature sensor is arranged in contact with the first major surface of the heat conducting metal sheet of the inner liner, and wherein the ice-lined storage device is configured to operate with the cold storage compartment having a temperature which is maintained between +2° C. and +8° C.

6. The ice-lined cold storage device of claim 1, wherein the ice lining extends around at least 50% of the periphery of the cold storage compartment.

7. A solar powered ice-lined cold storage device comprising: an insulated body; a cooling space within the insulated body; a cold storage compartment within the cooling space arranged at an interior of the ice-lined cold storage device; an ice-lining which extends around at least 50% of a periphery of the cold storage compartment and which is configured to absorb heat from the interior of the cold storage device; a cooling circuit configured to be power by one or more solar panels and configured, when in operation, to remove heat from the ice-lining; an inner liner which circumscribes the cold storage compartment and defines a substantially continuous perimeter of the cold storage compartment, the inner liner being arranged between the cold storage compartment and the ice-lining, and the inner liner comprising i) a heat conducting metal sheet having a first major surface which faces towards the cold storage compartment and a second major surface which faces towards the ice-lining; and ii) a thermally insulting foam material which separates the cold storage compartment from the ice-lining and which is arranged between the heat conducting metal sheet and the ice-lining; and an electrical heating element provided by an electrical heating wire which extends around at least 70% of a perimeter of the inner liner and which is arranged at the second major surface of the heat conducting metal sheet of the inner liner between the heat conducting metal sheet of the inner liner and the thermal insulating foam material of the inner liner; wherein the ice-lined storage device is configured to operate with it's the cold storage compartment having a temperature which is maintained between +2° C. and +8° C.; and wherein the electrical heating wire is configured to operate using power supplied by the one of more solar panels with a power consumption which is ≥5 W and ≤50 W.

8. The ice-lined cold storage device of claim 7, further comprising i) a temperature sensor arranged in contact with the first major surface of the heat conductive metal sheet of the inner liner, the temperature sensor being configured to provide an indication of a temperature of the cold storage compartment, and ii) a control system which controls operation of the electrical heating element on the basis of the indication of a temperature of the cold storage compartment provided by the temperature sensor.

9. The ice-lined cold storage device of claim 1, wherein the electrical heating wire comprises a wire loop within an electrically insulated sleeve with each of the two ends of the loop arranged at an electrical heating wire connector.

10. The ice-lined cold storage device of claim 1, wherein the heating element comprises a single electrical heating wire.

11. The ice-lined cold storage device of claim 1, wherein the electrical heating wire is rectilinear.

12. The ice-lined cold storage device of claim 1, wherein the electrical heating wire has a form selected from an undulating form and a wave-like form.

13. The ice-lined cold storage device of claim 1, wherein the electrical heating wire is adhered to the second major surface of the heat conducting metal sheet of the inner liner.

14. The ice-lined cold storage device of claim 1, wherein the electrical heating wire is sandwiched between and in contact with the heat conducting sheet of the inner liner and the thermal insulating material of the inner liner.

15. The ice-lined cold storage device of claim 1, wherein the volume of the cold storage compartment is ≥15 liters and ≤260 liters;

wherein the ice-lined storage device is configured to operate with the cold storage compartment having a temperature which is maintained between +2° C. and +8° C., and wherein the electrical heating wire is configured to operate with a power consumption which is ≥5 W and ≤50 W.

* * * * *